US005938032A

United States Patent [19]

Svec et al.

[11] Patent Number: 5,938,032

[45] **Date of Patent: *Aug. 17, 1999**

[54] TANDEM PACKAGE WITH PINHOLE

[75] Inventors: James A. Svec, Bloomingdale; Edward L. Nugent, North Caldwell; Kathryn K. Carpenter, Fort Lee; Frank Schicitano, Toms River, all of N.J.

[73] Assignee: Ivers-Lee Corporation, West Caldwell, N.J.

[ * ] Notice: This patent is subject to a terminal disclaimer.

[21] Appl. No.: 08/826,398

[22] Filed: Mar. 24, 1997

Related U.S. Application Data

[63] Continuation-in-part of application No. 08/530,805, Sep. 20, 1995, abandoned, and a continuation-in-part of application No. 08/532,927, Sep. 22, 1995, abandoned, which is a continuation-in-part of application No. 08/129,626, Sep. 30, 1993, Pat. No. 5,472,093.

[51] Int. Cl.[6] ..... B65D 83/04; B65D 65/36

[52] U.S. Cl. ..... 206/532; 206/539; 206/484; 383/200

[58] Field of Search ..... 206/532, 538, 206/539, 484; 383/38, 200, 204–209

[56] References Cited

U.S. PATENT DOCUMENTS

| | | | |
|---|---|---|---|
| Re. 27,913 | 2/1974 | Hutcheson . | |
| 2,051,922 | 8/1936 | Vogt . | |
| 2,245,738 | 6/1941 | Taylor | 383/38 X |
| 2,549,069 | 4/1951 | Donofrio | 206/484 |
| 2,756,874 | 7/1956 | Erickson et al. | 383/38 X |
| 3,105,609 | 10/1963 | Salfisberg . | |
| 3,124,913 | 3/1964 | Arcudi et al. . | |
| 3,164,695 | 1/1965 | Sanni . | |
| 3,283,885 | 11/1966 | Grunewald et al. | 206/532 X |
| 3,383,269 | 5/1968 | Kopp . | |
| 3,809,220 | 5/1974 | Arcudi | 206/484 |
| 4,176,567 | 12/1979 | Weisberg . | |
| 4,332,327 | 6/1982 | Frohwerk et al. . | |
| 4,398,634 | 8/1983 | McClosky | 206/532 |
| 4,614,076 | 9/1986 | Rathemacher . | |
| 4,725,329 | 2/1988 | Tani . | |
| 5,067,306 | 11/1991 | Umezawa . | |
| 5,088,603 | 2/1992 | Kirkpatrick | 206/484 X |
| 5,105,603 | 4/1992 | Natterer . | |
| 5,472,093 | 12/1995 | Nugent et al. | 206/532 |

*Primary Examiner*—Byron P. Gehman
*Attorney, Agent, or Firm*—Woodcock Washburn Kurtz Mackiewicz & Norris LLP

[57] ABSTRACT

A system of the present invention includes a tandem package and an apparatus and method for making the same. The tandem package includes a strip of film material having a plurality of medicament containing compartments. To prevent ripping or exposure of the medicament in an adjacent compartment upon opening of an individual segment of the package, each compartment is separated by a dividing member. In addition, to facilitate opening of the each segment while providing increased resistance to opening by children, each segment includes a pinhole in at least one corner of the segment perpendicular to a fold line. Thus to open the segment to expose the medicament, the corner may be folded along the fold line and torn at the pinhole, with the dividing member limiting tearing of the film. The apparatus and method of the present invention include a number of sub-assemblies for sealing the film, forming the compartments, placing the dividing member between the compartments, placing the dose of medicament in each compartment and cutting the continuous web into strips having the desired number of segments therein.

5 Claims, 12 Drawing Sheets

TANDEM PACKAGE WITH PINHOLE

CROSS-REFERENCE TO RELATED APPLICATION

The present application is a continuation in part of application Ser. No. 08/530,805 filed on Sep. 20, 1995, now abandoned and also a continuation in part of application Ser. No. 08/532,927 filed on Sep. 22, 1995, now abandoned which is a continuation in part of 08/129,626 filed on Sep. 30, 1993, now U.S. Pat. No. 5,472,093, all of which are incorporated herein in their entirety.

FIELD OF THE INVENTION

The present invention generally relates to packages for medicaments and the like such as for example aspirin and other pain relievers, and more specifically relates to a tandem package for enclosing or storing a dosage of at least one medicament, which is easily opened by adults but provides some resistance to being opened by children. In addition, the present invention relates to an apparatus and method for making such packages.

BACKGROUND OF THE INVENTION

Individual packages for medicaments are well known in the art and are typically provided as physician samples and the like. Such packaging usually contains a set of tablets such as aspirin or other medicaments, which may or may not be used at the same time.

Accordingly, several problems and limitations have been associated with the use of such packages including proper storage of the medicament when only one of the tablets are used or otherwise needed. In addition, such packages are easily opened by small children and provide insufficient resistance to being opened by children. Also, such packages are limited to only one pouch because of the tendency to tear into an adjoining pouch when opening.

In addition, a limitation has been associated with the use of such packages. Specifically, children have been able to manipulate these types of packages near a slit or tear notch and apply a force sufficient to tear the package open.

Thus, it would be desirable to provide a package, as well as an apparatus and method for making the same, which would eliminate the problems and limitations associated.

SUMMARY OF THE INVENTION

In contrast to the prior packages discussed above, it has been found that a tandem package particularly suited for use with multiple doses of at least one medicament in a unitary package can be constructed in accordance with the present invention. In addition, the tandem package of the present invention can be easily opened while maintaining the integrity of any adjoining compartments. Also the tandem package of the present invention increases resistance to being opened by children and the like, while still being easily opened by adults, including those who are handicapped or otherwise physically impaired.

The tandem package of the present invention for containing at least one medicament or the like, includes at least two segments, with each segment including a first portion and a second portion joined together at least partially along a periphery with at least one compartment formed therein, at least one dosage of medicament contained in each compartment, dividing means situated between adjoining segments and approximate each compartment so that upon opening of a segment by tearing the first portion and the second portion to remove the medicament from the compartment, advancement of tearing along the first portion and the second portion is limited or otherwise restricted so as not to continue into the compartment of an adjoining segment, and at least one pinhole and a fold line intersecting the pinhole, with both situated in close proximity to at least one edge of the first portion and the second portion of the segment, whereby the segment may be folded along the fold line and ripped at the pinhole.

In the preferred embodiment of the tandem package, the medicament includes a tablet. Also, the dividing means includes a filament material running along the periphery edge of the segment.

The method of making a tandem package of the present invention includes the steps of providing at least two ribbons of a film material, forming a plurality of compartments in the continuous web, providing a dividing material between adjacent compartments, placing at least one dose of a medicament in each compartment, sealing the ribbons of film material together to form a continuous web, and cutting the continuous web into strips including more than one segment with a corresponding compartment.

In the preferred embodiment of the method, the step of providing at least two ribbons of a film material includes the step of cutting a roll of film material into the ribbons of film. Also, the step of sealing the ribbons of film material together to form a continuous web includes the step of pressing the ribbons together between a pair of compartment forming means to form compartments therein. In the alternative, the step of forming compartments in the continuous web includes the step of providing at least one cavity in one of a pair of crimping rollers and at least one cavity in the other of the pair of crimping rollers so that when the crimping rollers come in contact with one another with the continuous web therebetween the periphery of the compartment is crimped and sealed together. In addition, the step of providing a dividing material between adjacent compartments includes the step of placing the dividing material between a pair of corresponding grooves formed in the pair of compartment forming means. Further, in the preferred method, the step of placing at least one dose of a medicament in each compartment includes the step of placing the dose of material between the crimping rollers and the ribbons of film as the ribbons enter the pair of crimping rollers. Also, the method further includes the step of forming opening means along at least one edge of the first ribbon and the second ribbon for facilitating opening of the tandem package.

The apparatus for making a tandem package of the present invention includes means for providing two ribbons of a film material, means for forming a plurality of compartments in the continuous web, means for providing a dividing member between adjacent compartments, means for placing at least one dose of a medicament in each compartment, means for sealing the ribbons of film material together to form a continuous web, and means for cutting the continuous web into individual strips having more than one compartment therein.

In the preferred embodiment of the apparatus, the means for sealing the ribbons of film material together to form a continuous web includes a pair of heated crimping rollers. Also, the means for forming at least one compartment between the ribbons of material includes a plurality of cavities formed in the pair of crimping rollers. In addition, the means for providing a dividing member between adjacent compartments includes a spool of threading subassembly for feeding a filament material between the crimping rollers. The apparatus also includes opening means for forming an opening member in the continuous web to facilitate opening of the tandem package, with the opening means preferably being adapted to include a punch having a male member and a female member for forming at least one pinhole adjacent each compartment.

BRIEF DESCRIPTION OF THE DRAWINGS

The various features, objects, benefits, and advantages of the present invention will become more apparent upon reading the following detailed description of the preferred embodiments along with the appended claims in conjunction with the drawings, wherein like reference numerals identify corresponding components, and:

DETAILED DESCRIPTION OF THE PREFERRED EMBODIMENTS

Figure 1:
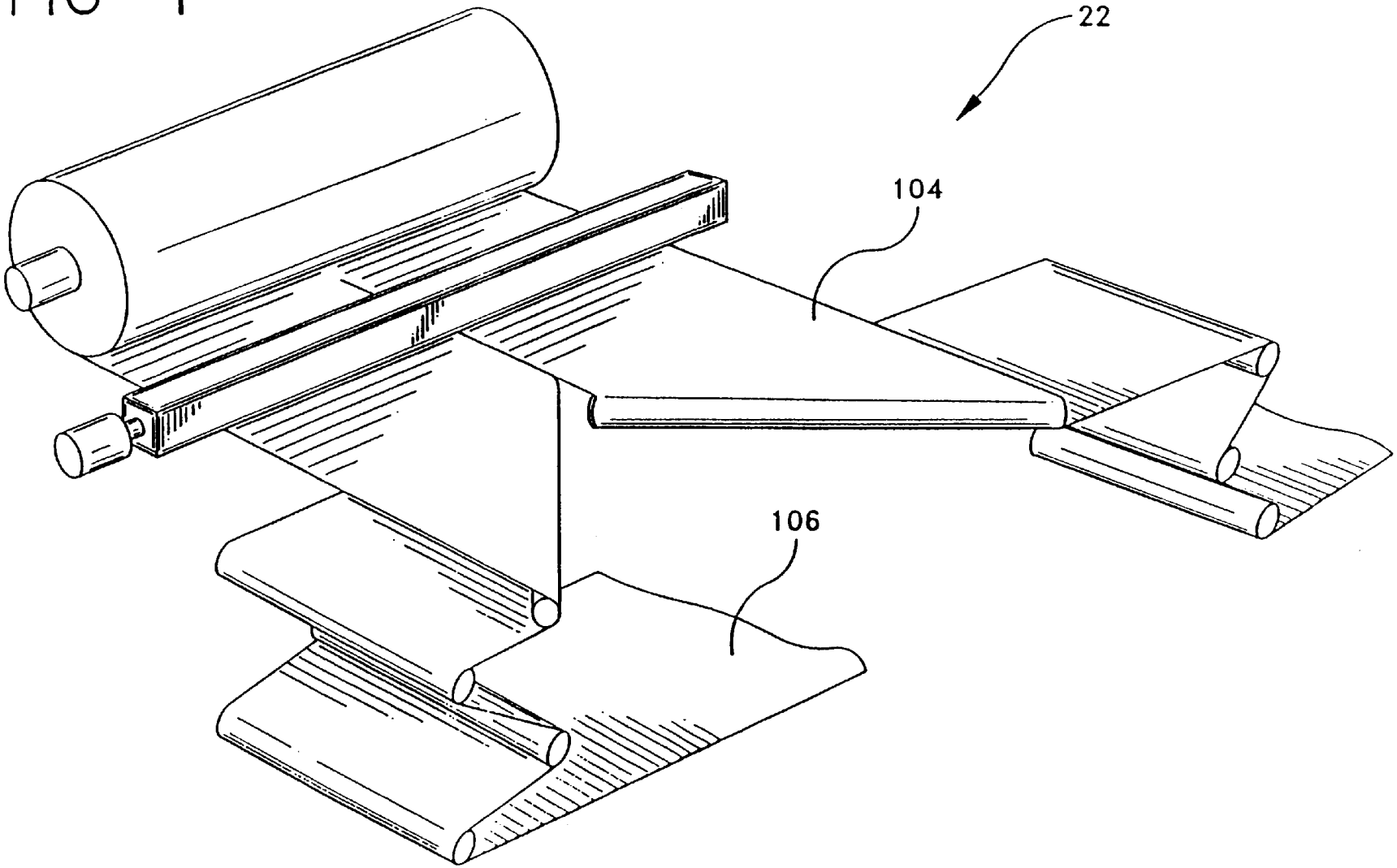
FIG. 1 is a perspective schematic view of a sub-assembly of the apparatus of the system of the present invention for making the tandem packages illustrating the step of splitting a continuous roll of film into a first ribbon and a second ribbon.

The system of the present invention is illustrated in FIGS. 1–12, with the apparatus generally designated as 20 and the tandem package generally designated as 100.

Referring to FIGS. 1–8, the apparatus 20 of the present invention includes a number of sub-assemblies 22, 24, 26, 28 and 30 for forming a continuous web 102 from individual ribbons of film 104 and 106 from which the tandem packages 100 are ultimately cut. Specifically, the apparatus includes a sub-assembly 22 for forming the ribbons of film 104 and 106 from a single roll of film or other packaging material, a sub-assembly 24 for sealing the ribbons of film together to form the continuous web 102 and for forming at least one compartment 108 between the ribbons of film, a sub-assembly 26 for providing a barrier or dividing member 110 between adjacent compartments formed in individual segments 112, a sub-assembly 28 for placing at least one dose of a medicament 200 in each compartment, and a sub-assembly 30 for cutting the continuous web into or individual strips having the desired number of segments for the particular tandem package 100. It should be readily apparent that whether the ribbons of film are formed from one roll of material of multiple rolls is not essential to the present invention.

Figure 2:
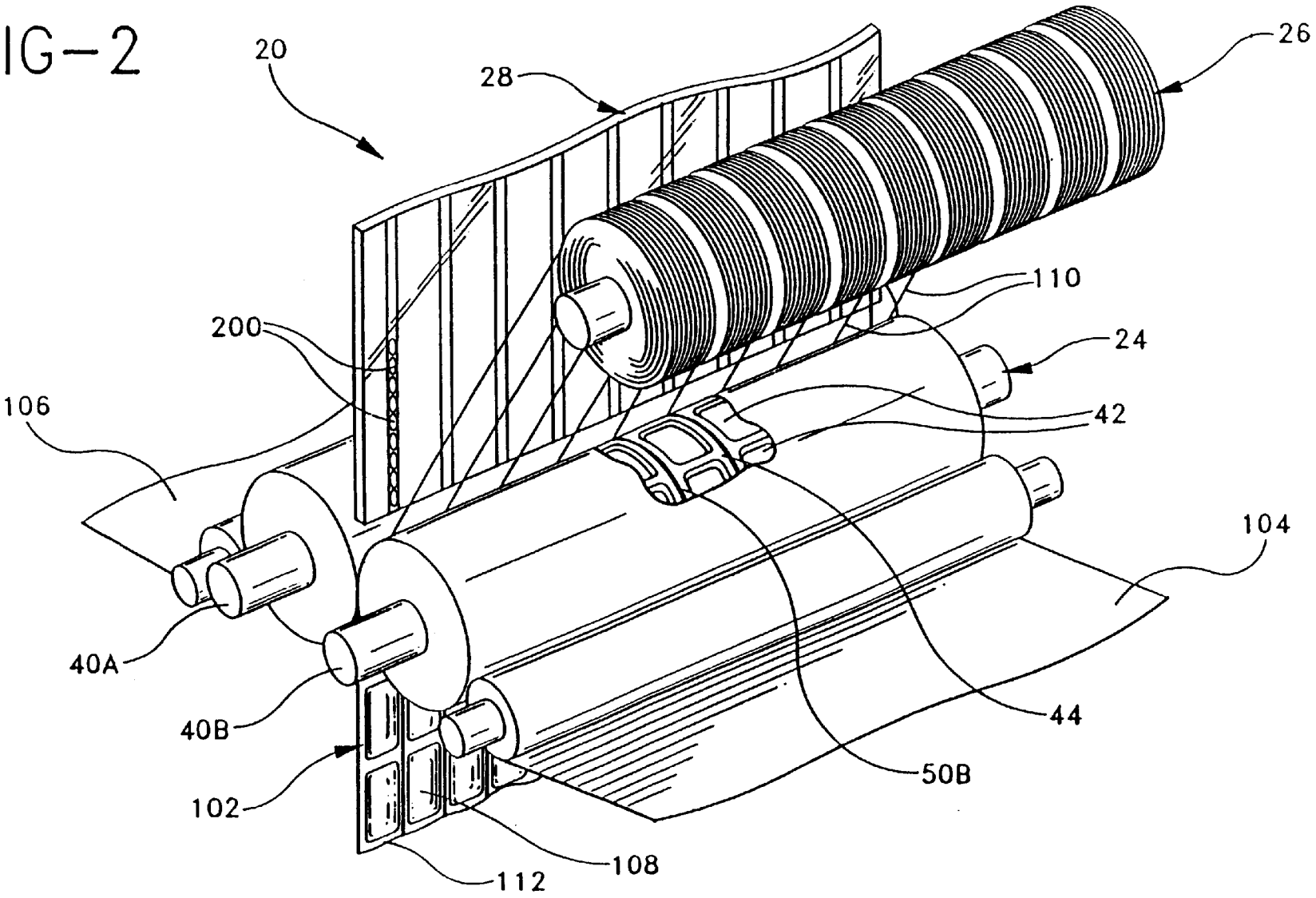
FIG. 2 is a perspective schematic view of a sub-assemblies of the apparatus of the system of the present invention for making the tandem packages illustrating the steps of sealing the ribbons of film together while forming a plurality of compartments in the continuous web, placing the desired medicament in each compartment and placing a dividing member between adjoining compartments.
Figure 5:
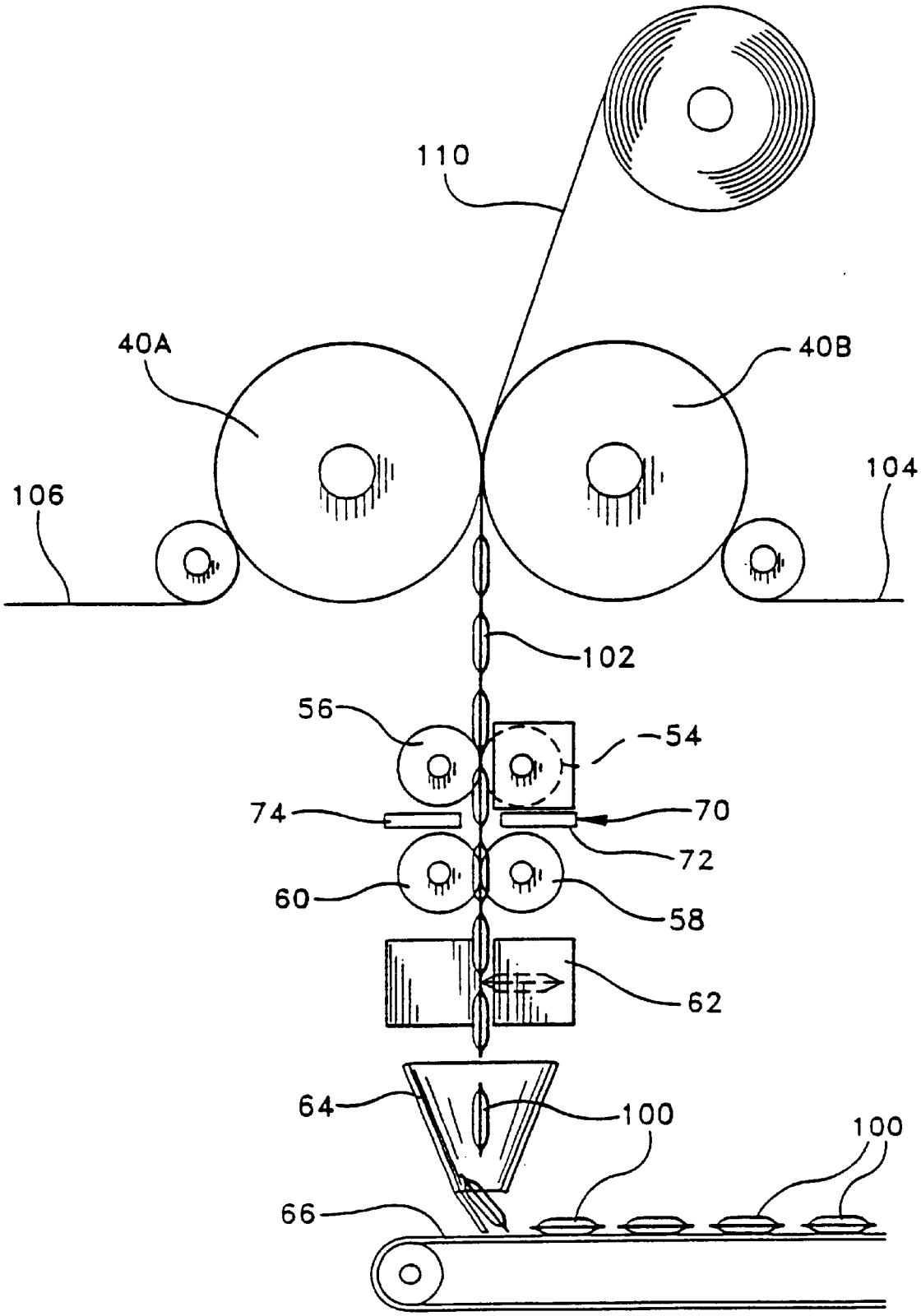
FIG. 5 is a perspective view of the various sub-assemblies of the apparatus of the system of the present invention for sealing the ribbons together to form a continuous web while forming the compartments with the dividing member therebetween and cutting the continuous web into the tandem packages having the desired number of segments.
Figure 6:
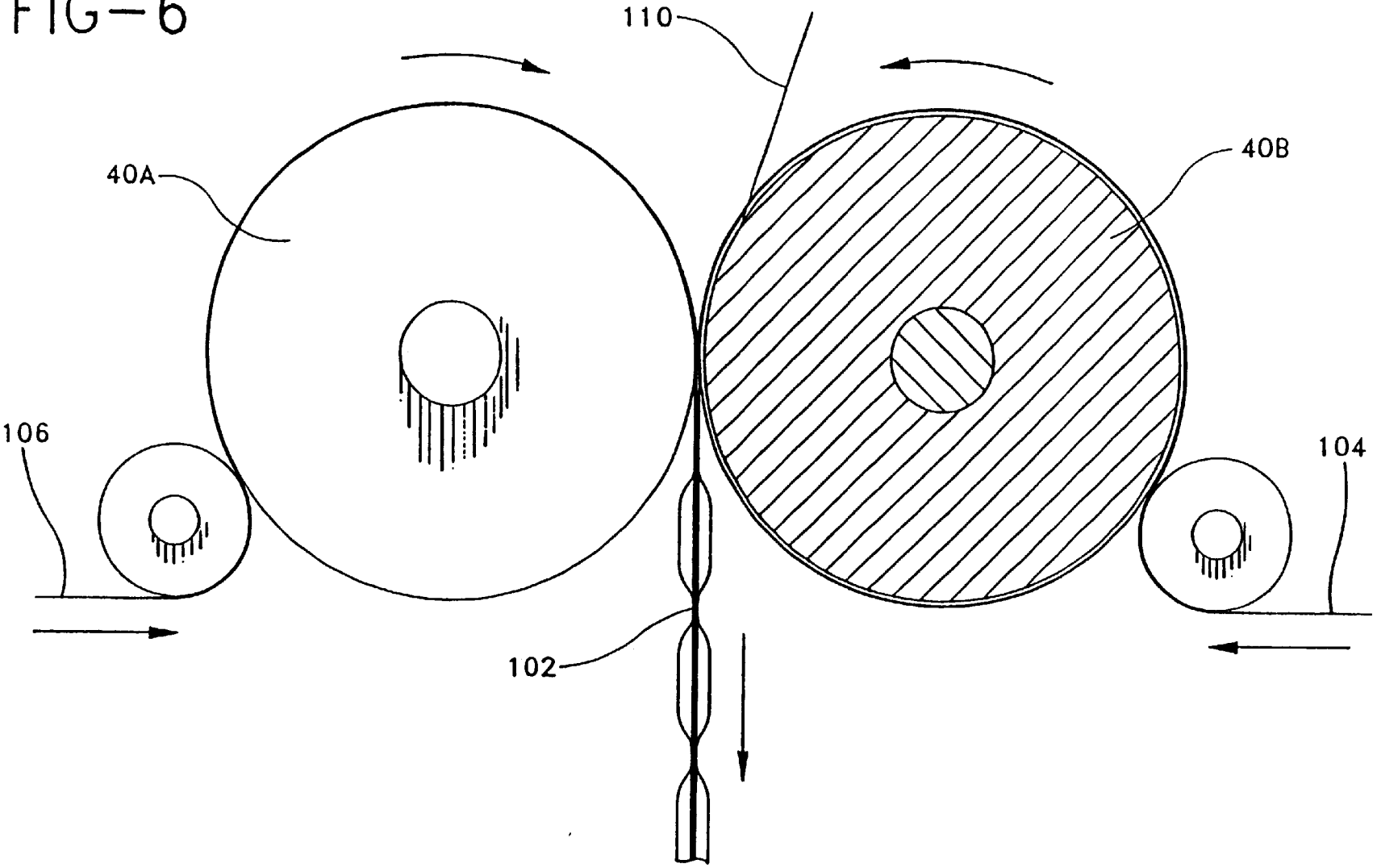
FIG. 6 is an enlarged, fragmentary side view of one of the sub-assemblies of the apparatus illustrated in FIG. 5 showing the direction of travel of the ribbons of film through the sub-assembly between the pair of forming rollers.
Figure 7:
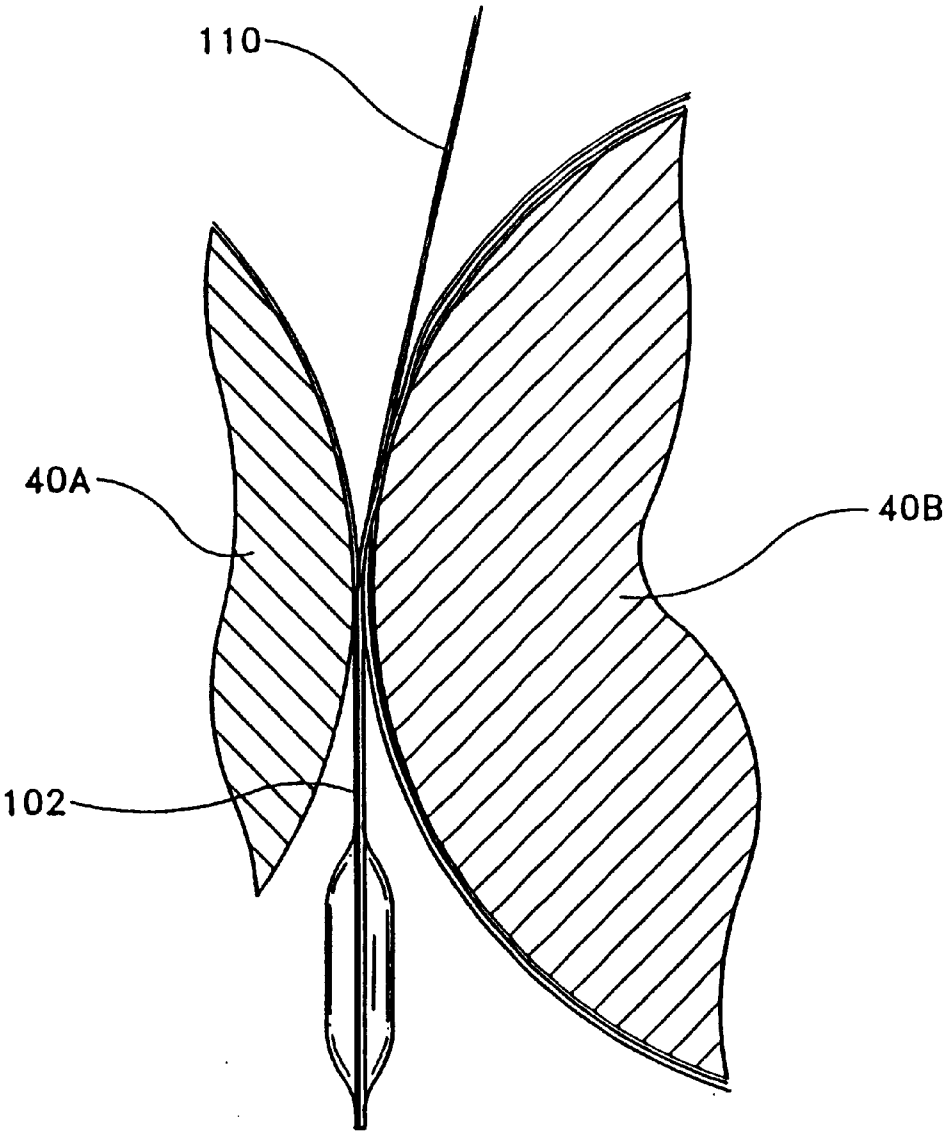
FIG. 7 is an enlarged fragmentary view of the pair of forming rollers illustrated in FIG. 6 showing the crimping of the ribbons of film together and the forming of the compartments therein.

As illustrated in FIG. 2, and in greater detail in FIGS. 5, 6 and 7, after the roll of film is cut into the two ribbons 104, 106 of the desired width, the ribbons are then fed into the sub-assembly 24 between a pair of crimping rollers 40A and 40B which cooperate to provide automatically and simultaneously the formation and sealing of the packages as is well known in the art as disclosed, for example, in U.S. Pat. No. 3,105,609 (Salfishberg), U.S. Pat. No. 3,124,913 (Arcudi et al.), and U.S. Pat. No. 4,614,076 (Rathemacher), the disclosures of which are hereby incorporated in their entirety.

In the preferred embodiment, each crimping roller includes a plurality of cavities or pockets 42 with border areas 44 extending around the entire periphery of the cavities along which each segment is crimped and sealed wit the dose of medicament 200 in each compartment 108. In this way, as the rollers rotate in unison, the ribbons 104, 106 are crimped between the rollers along the border areas 44 to define each segment or pouch 112 in the continuous web 102 with films 104 and 106 being heat sealed together.

Figure 3:
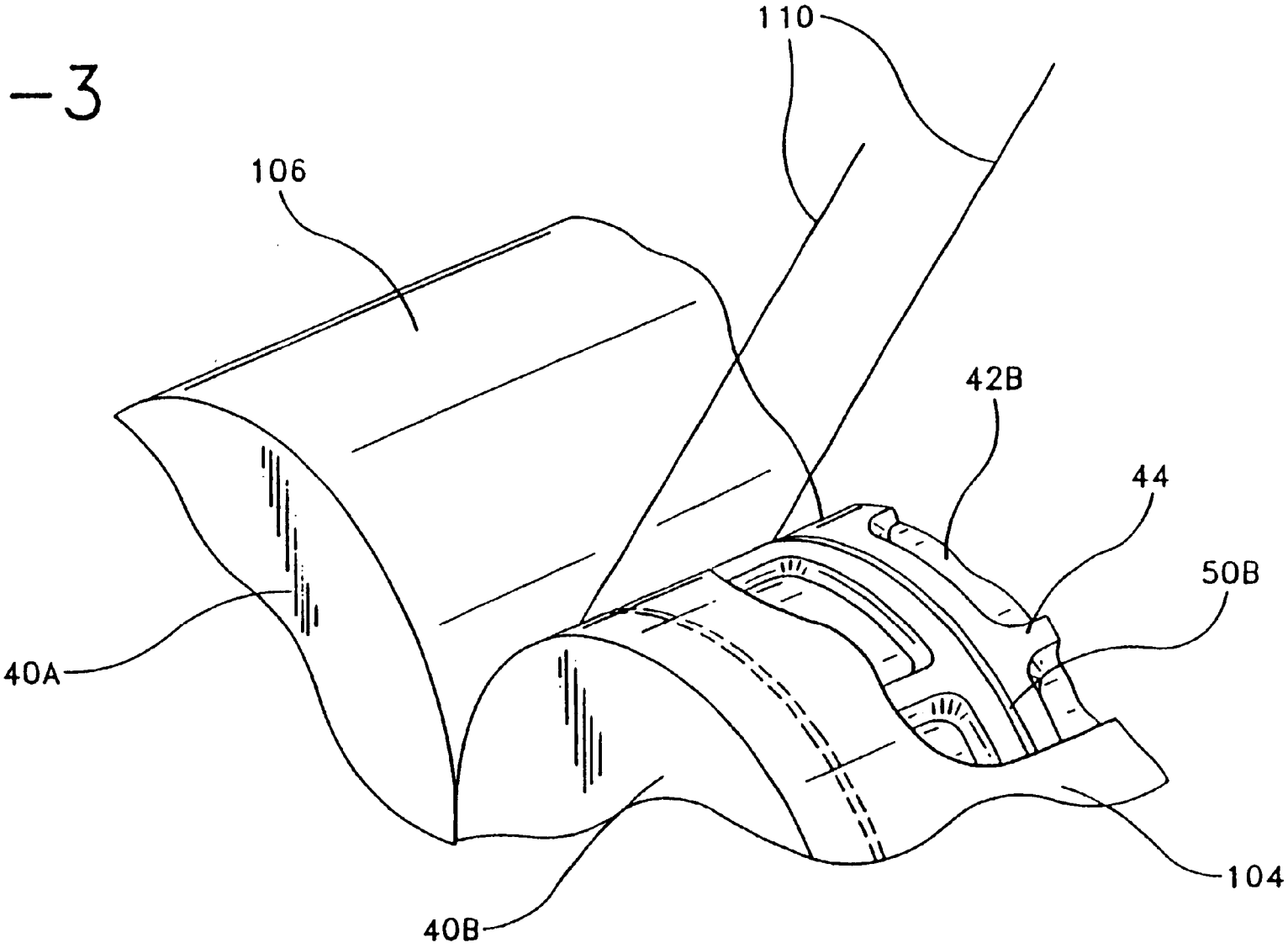
FIG. 3 is an enlarged fragmentary view of one of the sub-assemblies illustrated in FIG. 2 showing the feeding of the dividing member between the pair of forming rolls.
Figure 4:
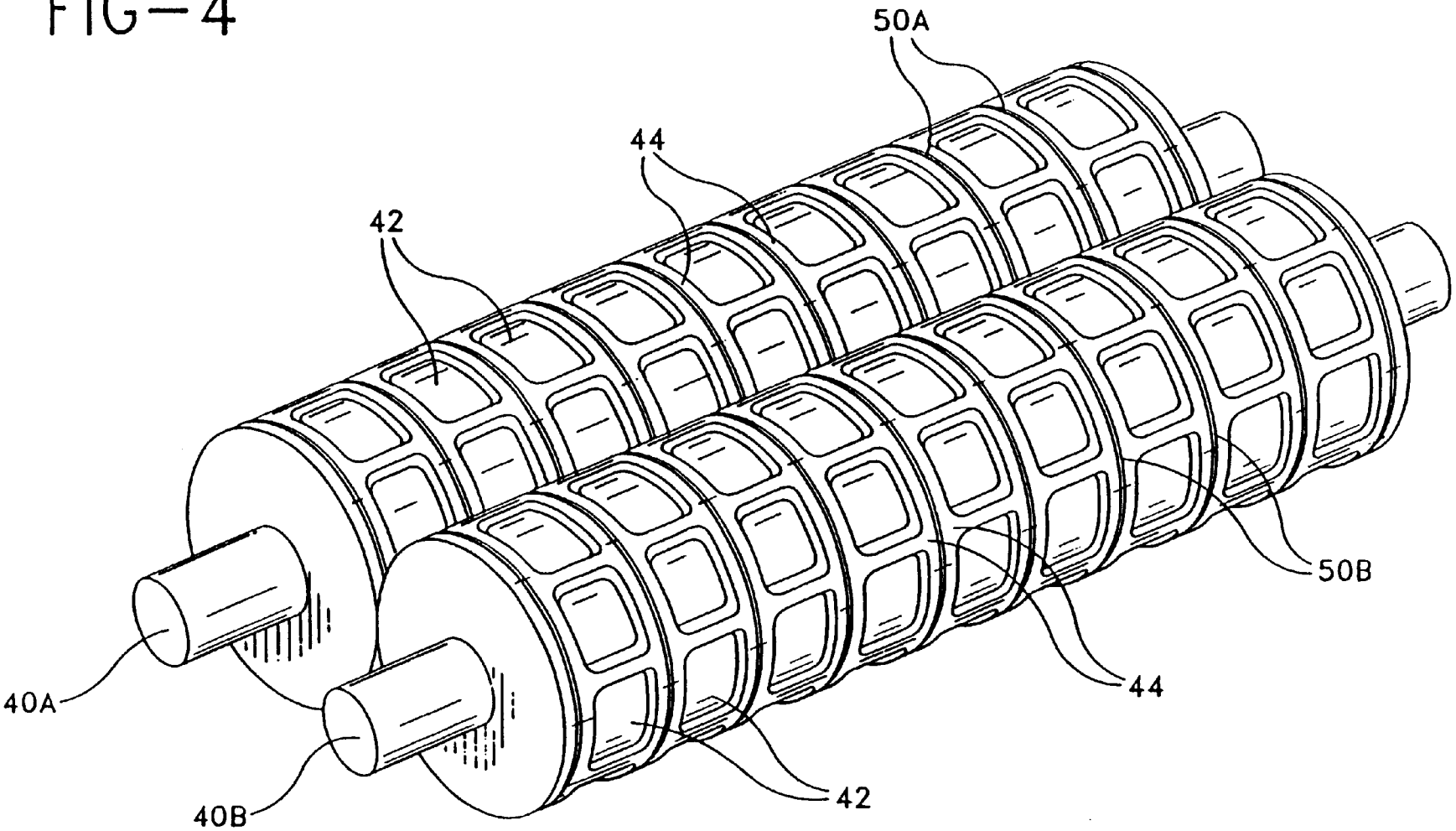
FIG. 4 is a perspective view of the pair of forming rolls of one of the sub-assemblies illustrated in FIG. 2.

Also, in the preferred embodiment, a channel or groove 50A with an opening portion 52A formed in one roller 40A and a corresponding groove 50B with an opening portion 52B formed in the other roller 40B as illustrated in FIGS. 2, 3 and 4. As the rollers rotate in unison about their central axis, the opening portions 52A, 52B of the grooves 50A, 50B come in abutting contact with one another. In this way, the dividing member 108, such a string or filament can be placed or otherwise guided between the ribbons of film 104, 106 as they are brought in contact with one another between the crimping rollers. Also, in this way, the dividing member 110 is sealed within the continuous web 102 between the two ribbons of film 104, 106 and between adjacent compartments 42 in the surrounding area 44 of the individual segments 112. It should be readily apparent that the grooves 50A, 50B and the dividing member 110 can be sized such that as the grooves are brought together, the dividing member is gripped therebetween and pulled along through the rollers by the continuous web 102. Also, alternatively, only one of the rollers could include the groove with the dividing member sandwiched therein or otherwise accommodated.

In addition, as illustrated in FIG. 2, a dose of medicaments 200 is placed between the ribbons of film 104, 106 by the sub-assembly 28 as is well known in the art, as disclosed for example in U.S. Pat. No. 3,105,609 (Salfishberg) and U.S. Pat. No. 3,124,913 (Arcudi et al.). In the preferred embodiment, the sub-assembly 28 includes plungers to push the medicament into the compartment 108 formed in the continuous web 102. The dose of medicament 200 can be varied depending upon the substance used, which may, for example, include creams, tablets, granulars, powders, and the like to name a few. Accordingly, it should be appreciated that creams and dry forms of medicaments may be placed in the compartments 108 of each segment 112 as the two ribbons of film are crimped and sealed together.

As illustrated in FIG. 5, after the continuous web 102, with the medicament contained in the various compartments passes through the sub-assembly 24, the continuous web is cut along the vertical direction by a pair of cooperating slitter rolls 54, 56 at desired intervals depending upon the number of segments 112 and corresponding compartments 108 to be included in each strip in the horizontal direction. Once the web 102 passes through the slitter rolls, 54, 56 for slitting the web, the plurality of strips pass through friction rolls 58, 60 which serve to hold the strips in proper alignment under tension for feeding to a knife station 62. In the knife station, the strips are cut along the horizontal direction at desired intervals depending upon the number of segments 112 to be included in the vertical direction in the individual tandem packages 100 of the present invention, which then drop into a guide station 64 on the top of a conveyor 66.

It should also be appreciated that the desired intervals in either the vertical and/or the horizontal direction can be varied depending upon, for example, whether more than one medicament is to be provided in the tandem package. This ability to vary the amount of segments and corresponding compartments in the tandem package 100 permits dosing for a multiple of days or periods depending upon the recommended dosage of the particular medicament or medicaments prescribed and the directions by the physician. For example, where the medicament is to be taken twice a day for a period of ten days, the tandem package 100 can include two segments in the horizontal direction and a row of ten segments in the vertical direction. It should be appreciated that other forms of cutting means may be utilized in connection with this sub-assembly to cut or otherwise form the strips from the continuous web 102.

Figure 10:
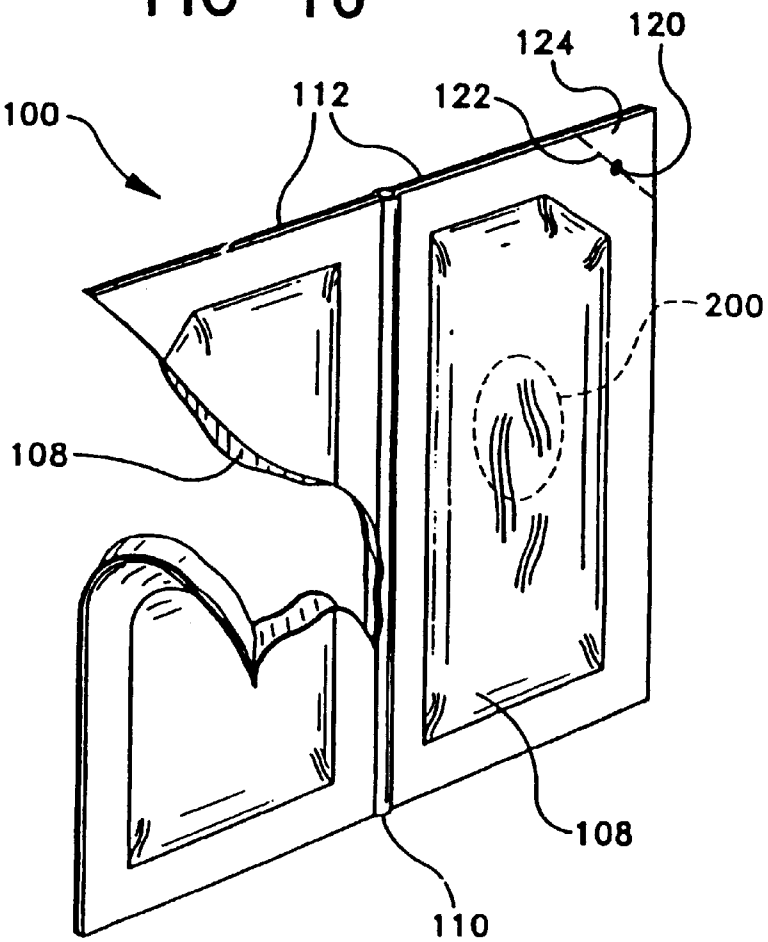
FIG. 10 is an enlarged perspective view of the tandem package illustrated in FIG. 9 showing opening of the package and the ripping of one segment of the tandem package.
Figure 9:
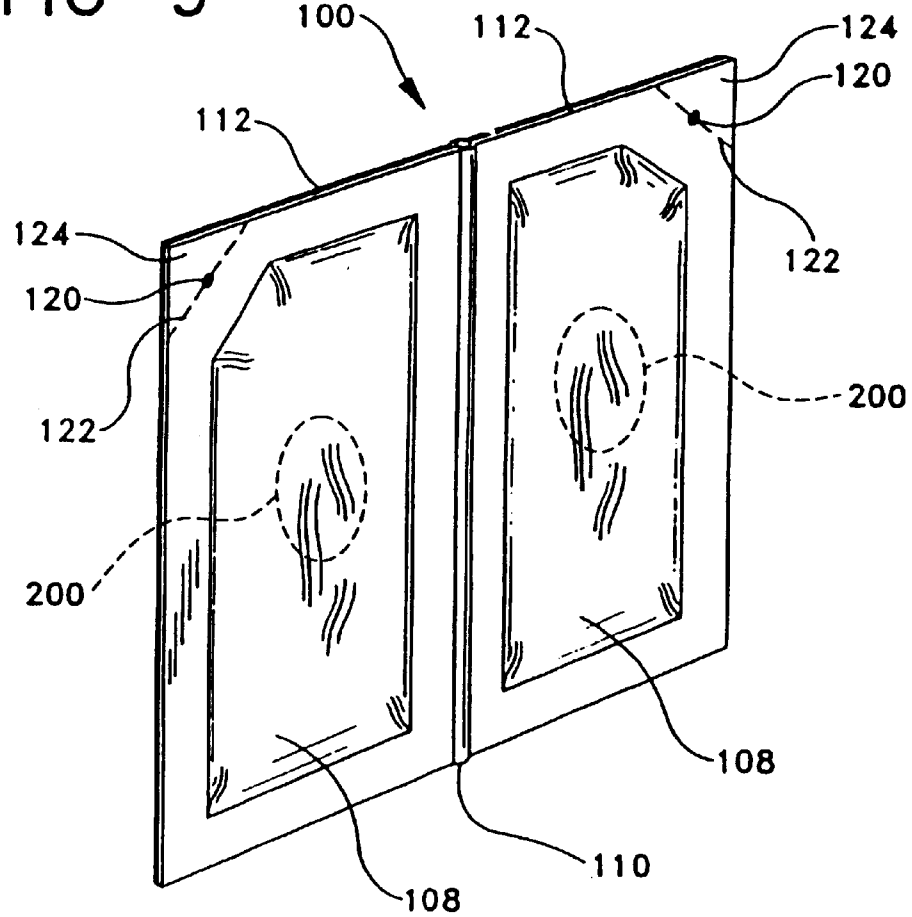
FIG. 9 is an enlarged perspective view of the tandem package of the present invention with two segments and corresponding medicament containing compartments.

In the preferred embodiment of the tandem package of the present invention illustrated in FIGS. 5, 9 and 10, at least one corner of a segment 112 includes opening means in the form of a slit, tear notch or preferably a pinhole 120 spaced from the adjacent edge with a printed fold line or like portion 122 running perpendicular to the pinhole 120 to provide ease of opening, while providing some degree of resistance to opening by children. In the preferred embodiment, the segment also includes an unsealed area 124 situated between the fold line and the corner edge. In this way, in order to open the particular segment of the package, the edge must first be folded over along the fold line 122, and then torn in the direction of the pinhole 120. Also, as shown in FIG. 10, ripping of the package projects into the compartment and the force exerted is limited or otherwise restricted by the dividing member 110 provided between each segment.

Figure 8:
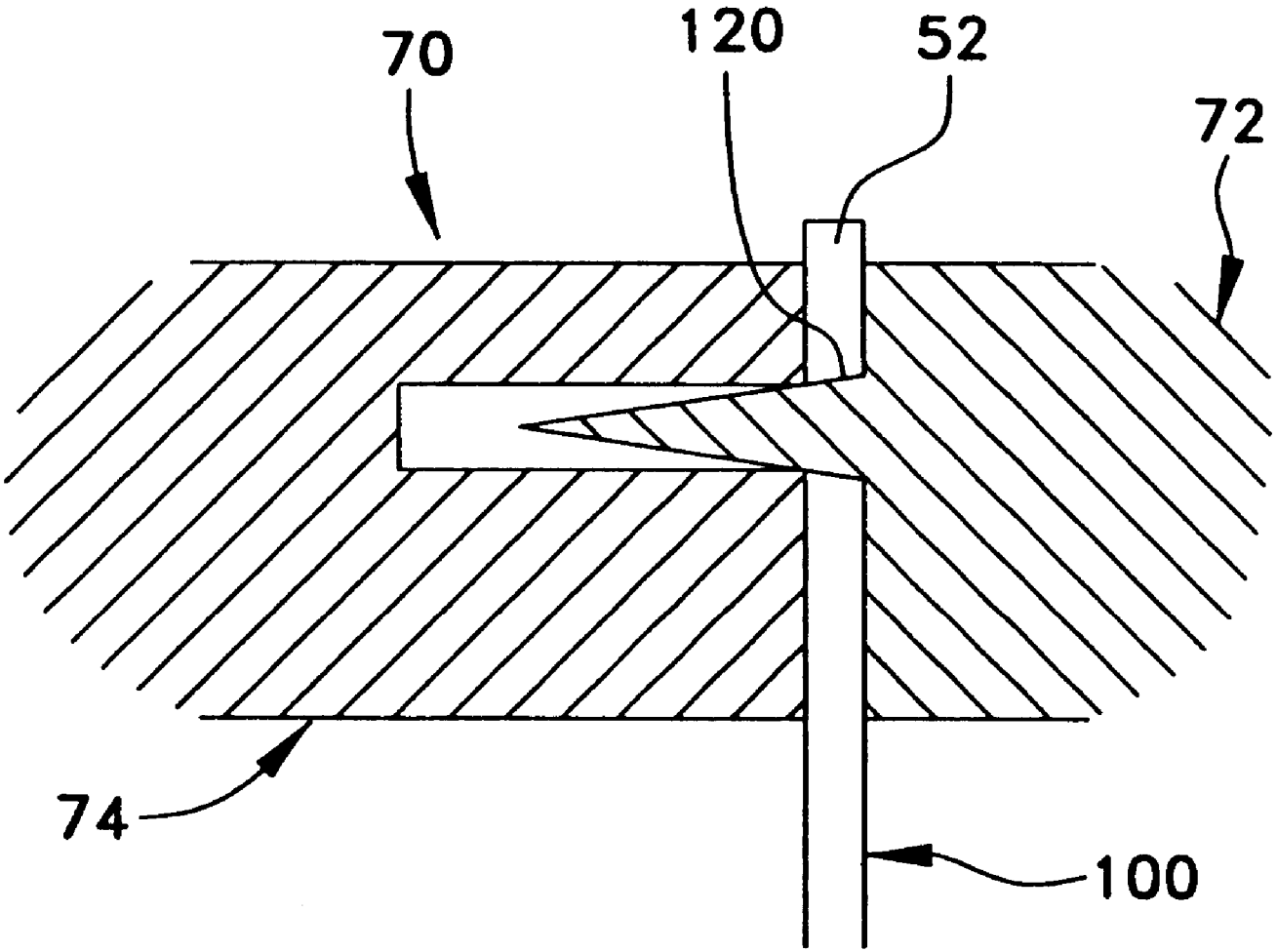
FIG. 8 is an enlarged fragmentary view of the punch for forming the pinhole in the tandem package.

In the preferred embodiment, the pinhole 120 is formed in each segment by a reciprocating punch 70 having a circular male member 72 and a corresponding female member 74 after the continuous web is cut-by the slitter rolls 54, 56 and while the strips are still under tension. In this way, the segment 112 is placed between the members 72, 74, which are brought together with the opening portion 52 therebetween to form an approximately 1/16 inch pinhole therein as illustrated in FIG. 8.

Figure 11:
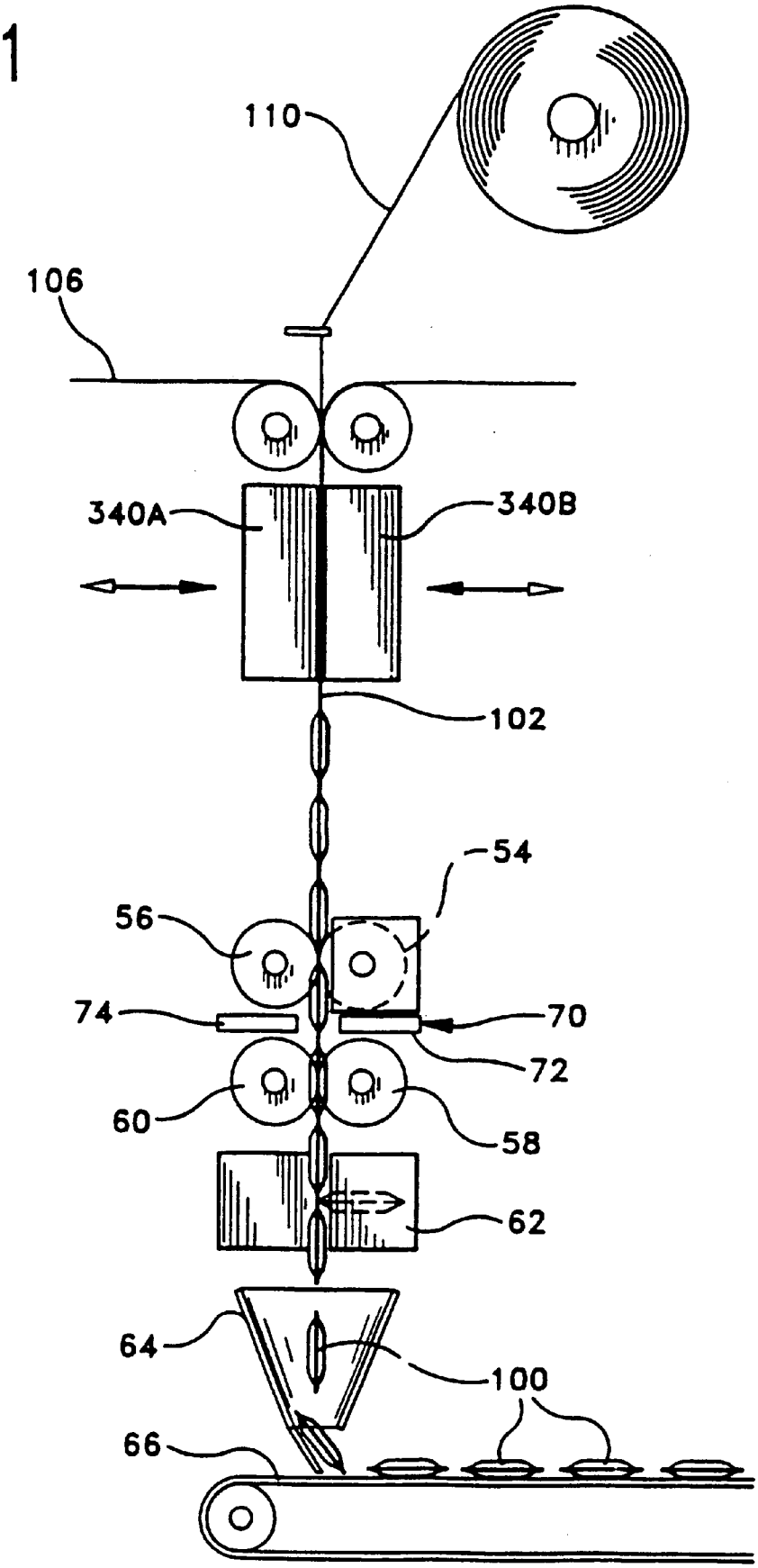
FIG. 11 is a perspective view of an alternative embodiment of the sub-assemblies of the apparatus of the system of the present invention for sealing the ribbons of film together into a continuous web and for forming the compartments with the dividing member therebetween and cutting the continuous web into the tandem package having the desired number of segments.

In an alternative embodiment illustrated in FIG. 11, the sub-assembly for sealing the two ribbons of film together and forming the compartments therein, may include a pair of retractable molds 340A and 340B, which can be actuated in the horizontal direction.

Also, the materials used for the tandem package of the present invention are not essential to the present invention and may be made from a variety of commercially available materials which in the preferred embodiment includes a 4–5 mil thick laminate film of polyester, foil and polyethylene with the polyethylene portions of each film being heat sealed together. Normally, manufacturers of the tandem package will select the various materials, based upon price, availability and application.

Figure 12:
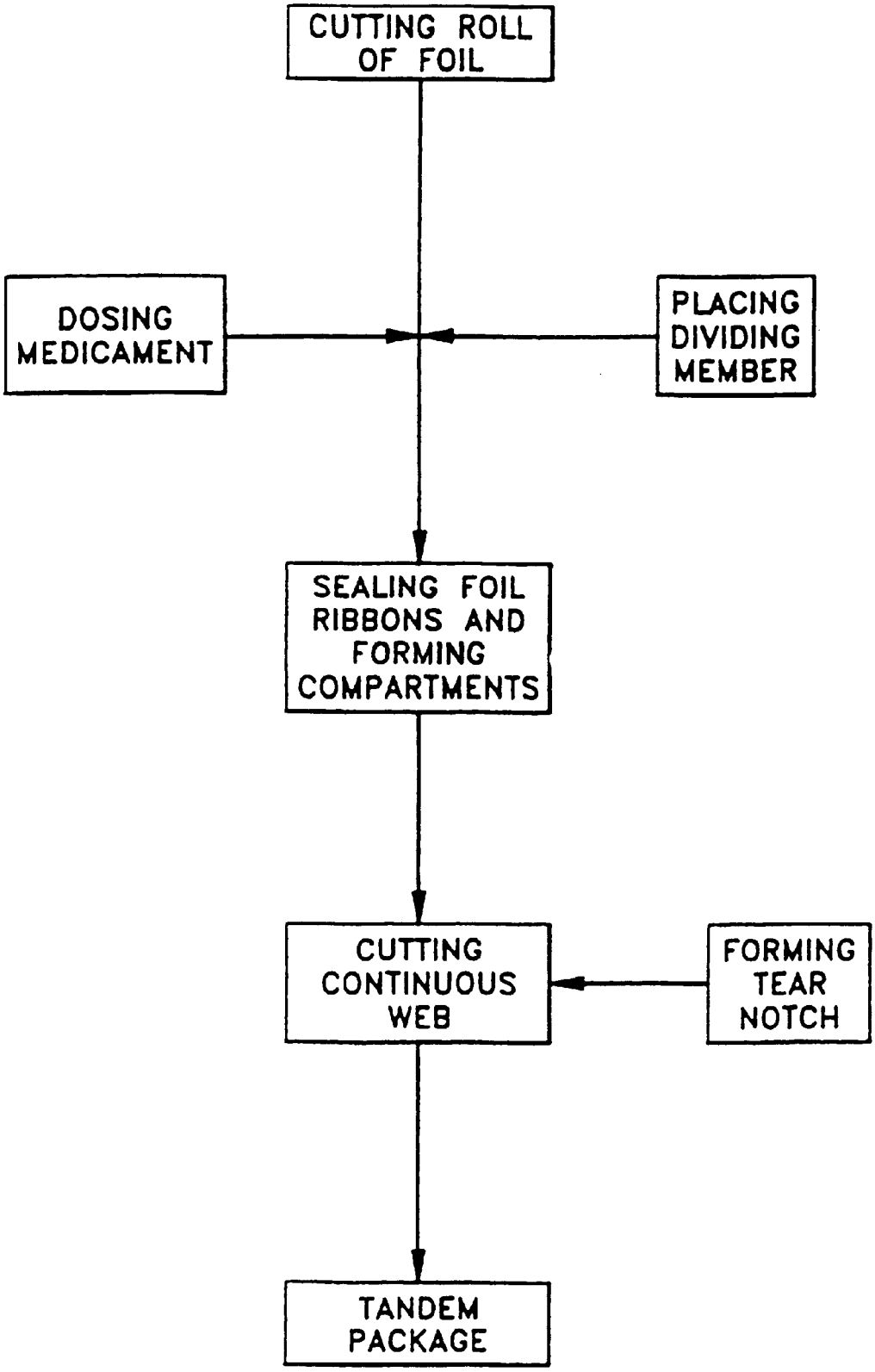
FIG. 12 is a logic flow diagram depicting the various steps of the method for making the tandem package of the present invention.

The operation of the system of the present invention in connection with the apparatus 20 illustrated in FIGS. 1–8 will now be explained with reference to the flow diagram shown in FIG. 12 illustrating the various stations making up the sub-assemblies 22, 24, 26, 28 and 30.

As explained, in the preferred embodiment, the roll of film is split into two ribbons of film 104 and 106 by sub-assembly 22, and the ribbons are then processed along separate tracks through the sub-assembly 24 for sealing the ribbons together to form the continuous web 102 with the segments and compartments defined therein. As the ribbons of film are crimped together, the sub-assembly 26 placed the dividing member 108 between the ribbons and the sub-assembly 28 places the dose of medicament in the various compartments. Thereafter, the sub-assembly 30 cuts the continuous web 102 into various strips having the desired number of segment in the horizontal and vertical directions to form the individual tandem package 100 of the present invention. In addition, during cutting of the web, the pinhole 120 and fold line 122 are formed in each segment 112 adjacent at least one compartment 108.

Use of the tandem package 100 of the present invention as illustrated in FIG. 5, and in greater detail in FIGS. 9 and 10, will now be explained. Initially, the desired segment 112 of the tandem package 100 is folded along the fold line 122 to expose the pinhole 120. Next, the segment is gripped on each side of the pinhole and ripped at the pinhole 120 to expose the medicament 200 contained in the compartment 108. In the preferred embodiment, the dividing member, such as a filament, is positioned between adjacent segments of the tandem package to limit or otherwise restrict the ripping of the film material from proceeding into the adjacent compartment as illustrated in FIG. 10. It should also be appreciated that the pinhole may be placed in other areas along the periphery of the segment, such as for example the sides.

In addition, the tandem package 100 of the present invention can be fabricated or otherwise cut from the continuous web in a number of shapes and lengths other than that shown in the drawings. Also, the tandem package can be made in different sizes depending upon whether it is to contain dosages for adults or infants.

Figure 14:
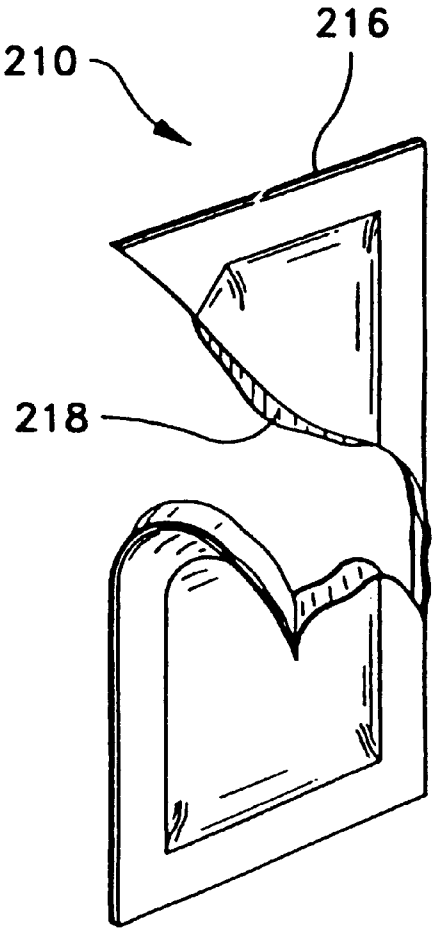
FIG. 14 is a perspective view of the package in FIG. 13 being opened.
Figure 13:
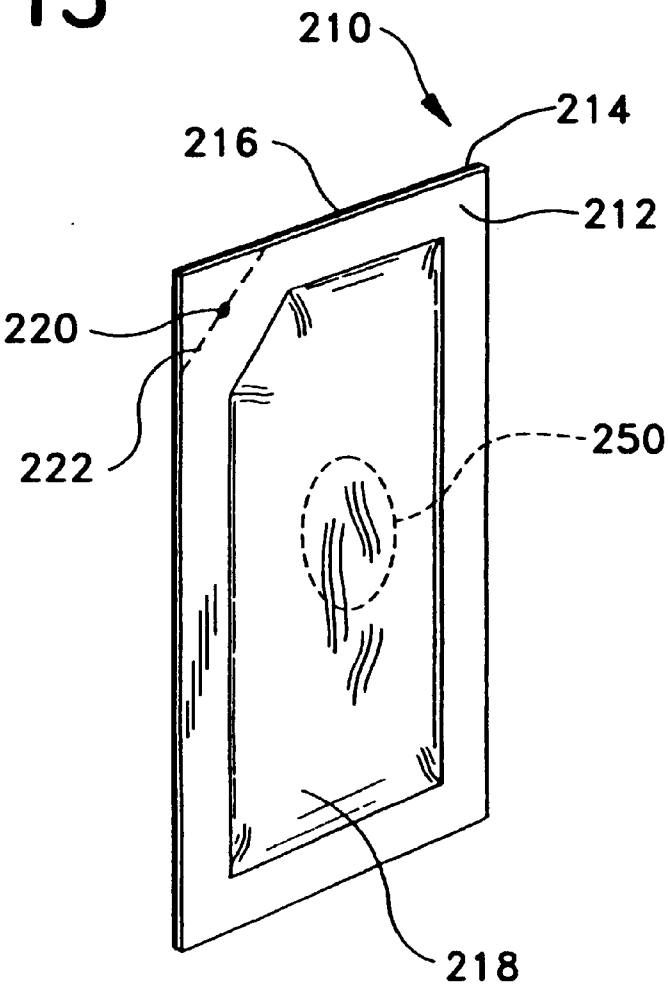
FIG. 13 is a perspective view of another embodiment in accordance with the present invention.

A package 210 in accordance with another aspect of the present invention is illustrated in FIGS. 13 and 14. Package 210 comprises a first panel 212 (front) and a second panel 214 (back) that are crimped and heat sealed together to form a segment 216, with at least one compartment 218 formed between the panels 212, 214 and an opening portion 218 adjacent at least one edge. The particular method and apparatus for making the package is not essential to present invention, and may include the apparatus and method described above for manufacturing the tandem package 100.

As is well known in the art, a dose of medicaments 250 is placed in each compartment 218. The dose of medicaments 250 can be varied depending upon the substance used, which may, for example, include creams, tablets, granulars, powders, and the like to name a few. Accordingly, it should be appreciated that creams and dry forms of medicaments may be placed in the compartments 218 of each segment 216 as the two panels are crimped and sealed together.

The opening portion 218 includes at least one pinhole 220 formed therein and spaced from the edge of the segment 216 to provide ease of opening, which also provides some degree of resistance to opening by children. Also to facilitate opening, a score or fold line 222 can be included which intersects the pinhole 220 so that the opening portion can be folded over along the fold line 222, and then torn in the direction of the pinhole 220. The circular shape of the pinhole 220 is essential to the invention in the event a child manipulates the package and exerts a shear force, which reduces the likelihood of tearing the package open. As shown in FIGS. 13 and 14, the opening portion 218 consists of the pinhole 220 and the fold line 222. In this embodiment, the pinhole 220 and the fold line 222 are the only features on the panels 214, 214 that contribute to the tearing of the package 210.

The pinhole 220 is formed in the opening portion 218 by the reciprocating punch 70 having circular male member 72 and corresponding female member 74. In this way, the segment 216 is placed between the members 72, 74, which are brought together with the opening portion therebetween to form an approximately 1/16 inch pinhole therein as illustrated in FIG. 8.

The materials used for the package 210 of the present invention are not essential to the present invention and may be made from a variety of commercially available materials which in the preferred embodiment includes a 4–5 mil thick laminate film of polyester, foil and polyethylene with the polyethylene portions of each film being heat sealed together. Normally, manufacturers of the package will select the various materials, based upon price, availability and application.

The use of the package 210 of the present invention as illustrated in FIGS. 13 and 14 will now be explained. Initially, the segment 216 of the package 210 is folded along the fold line 222 to expose the pinhole 220. Next, the segment is gripped on each side of the pinhole and sufficient force is applied to rip or tear the package at the pinhole to expose the medicament 250 contained in the compartment 218. It should also be appreciated that the pinhole may be placed in other areas along the periphery of the segment, such as for example the sides.

In addition, the package 210 of the present invention can be fabricated or otherwise cut from a continuous web in a number of shapes and lengths other than that shown in the drawings. Also, the package can be made in different sizes depending upon whether it is to contain dosages for adults or infants.

While preferred embodiments of the present invention have been described so as to enable one skilled in the art to practice the system, including the tandem package, apparatus and method, of the present invention, it is to be understood that variations and modifications may be employed without departing from the concept and intent of the present invention as defined in the following claims. The preceding description is intended to be exemplary and should not be used to limit the scope of the invention. The scope of the invention should be determined only by reference to the following claims.

What is claimed is:

1. A tandem package for containing at least one medicament, comprising:

at least two segments, with each segment including a first portion and a second portion joined together at least partially along a periphery with at least one compartment formed therein;

at least one dosage of medicament contained in each compartment;

dividing means situated between adjoining segments and approximate each compartment so that upon opening of one segment by tearing said first portion and said second portion to remove said medicament from said compartment, advancement of tearing along said first portion and said second portion is limited or otherwise restricted so as not to continue into the compartment of an adjoining segment; and at least one pinhole and a fold line intersection at said at least one pinhole, with both said at least one pinhole and said fold line situated in close proximity to at least one edge of said first portion and said second portion of one segment, whereby said segment may be folded along said fold line and ripped at said at least one pinhole.

2. The tandem package defined in claim 1, wherein said medicament includes a tablet.

3. The tandem package defined in claim 1, wherein said dividing means includes a filament material running along the periphery edge of at least one of said adjoining segments.

4. A package for containing at least one medicament, comprising:

a segment having a first panel and second panel joined together at least partially along a periphery with at least one compartment formed therein;

at least one dosage of medicament contained in the at least one compartment;

a pinhole situated in close proximity to at least one edge of said segment; and a fold line intersecting said pinhole, whereby said segment may be folded along said fold line and ripped along said pinhole, wherein said pinhole and said fold line are the only features on said first and second panels that contribute to the ripping of said segment along said pinhole.

5. The package defined in claim 4, wherein said panels are crimped and heat sealed together to form said segment.

* * * * *